US009849502B2

(12) United States Patent
Gaertner et al.

(10) Patent No.: US 9,849,502 B2
(45) Date of Patent: Dec. 26, 2017

(54) BLIND RIVET SETTING DEVICE

(71) Applicant: GESIPA BLINDNIETTECHNIK GMBH, Moerfelden-Walldorf (DE)

(72) Inventors: Richard Gaertner, Griesheim (DE); Lothar Wille, Moerfelden-Walldorf (DE); Michael Leinweber, Heusenstamm (DE); Alex Schoenberner, Muenster (DE)

(73) Assignee: GESIPA BLINDNIETTECHNIK GMB, Moerfelden-Walldorf (DE)

( * ) Notice: Subject to any disclaimer, the term of this patent is extended or adjusted under 35 U.S.C. 154(b) by 216 days.

(21) Appl. No.: 14/628,659

(22) Filed: Feb. 23, 2015

(65) Prior Publication Data

US 2015/0336159 A1 Nov. 26, 2015

(30) Foreign Application Priority Data

Feb. 24, 2014 (EP) ..... 14156307

(51) Int. Cl.
*B21J 15/00* (2006.01)
*B21J 15/10* (2006.01)
(Continued)

(52) U.S. Cl.
CPC ..... *B21J 15/105* (2013.01); *B21J 15/043* (2013.01); *B21J 15/26* (2013.01); *Y10T 29/49957* (2015.01); *Y10T 29/53752* (2015.01)

(58) Field of Classification Search
CPC ... B21J 15/00; B21J 15/16; B21J 15/24; B21J 15/28; B21J 15/105; B21J 15/26; B21J 15/043; Y10T 29/49957; Y10T 29/53752
(Continued)

(56) References Cited

U.S. PATENT DOCUMENTS 4,085,337 A * 4/1978 Moeller ..... B21J 15/048 173/205
4,375,760 A * 3/1983 Savage ..... B21J 15/043 29/243.519
(Continued)

FOREIGN PATENT DOCUMENTS

CN 2910413 6/2007
CN 101583443 11/2009
(Continued)

OTHER PUBLICATIONS

Chinese Office Action issued in Application No. 201510087386.9, dated Apr. 6, 2016, along with an English translation thereof.
(Continued)

*Primary Examiner* — Sarang Afzali
*Assistant Examiner* — Darrell C Ford
(74) *Attorney, Agent, or Firm* — Greenblum & Bernstein, P.L.C.

(57) ABSTRACT

A blind rivet setting device and method of setting a blind rivet. The device includes a housing; a pulling mechanism, arranged in the housing, that includes a chuck housing movable in a pulling direction and clamping jaws movable along a clamping distance in the chuck housing; an electric drive, structured and arranged to act on the chuck housing, that includes a control device; an electric battery structured and arranged as an energy source for the electric drive; and a spring structured and arranged in the chuck housing to apply a force to clamping jaws. For each clamping jaw, the chuck housing includes a guide path with a path base obliquely oriented to the pulling direction, and a back of each clamping jaw is supported against its respective path base over the clamping distance.

21 Claims, 3 Drawing Sheets

(51) Int. Cl.

| | |
|---|---|
| ***B21J 15/04*** | (2006.01) |
| ***B21J 15/26*** | (2006.01) |
| *B23P 11/00* | (2006.01) |
| *B21J 15/02* | (2006.01) |

(58) Field of Classification Search
USPC ..... 29/525.07, 243.526, 243.521, 525.01, 29/525.05, 525.06, 34 B, 243.53
See application file for complete search history.

(56) References Cited

U.S. PATENT DOCUMENTS 4,517,820 A * 5/1985 Oefinger ..... B21J 15/105 29/243.525
4,541,266 A * 9/1985 Totsu ..... B21J 15/043 72/391.6
4,653,308 A * 3/1987 Gregory ..... B21J 15/043 29/243.5
4,901,431 A * 2/1990 Gast ..... B21J 15/105 227/1
5,184,497 A * 2/1993 Hanlon ..... B21J 15/043 29/243.521
5,231,747 A * 8/1993 Clark ..... B21J 15/10 227/152
5,471,865 A * 12/1995 Michalewski ..... B21J 15/24 29/243.53
5,473,805 A 12/1995 Wille
5,661,887 A * 9/1997 Byrne ..... B21J 15/105 227/2
5,802,691 A * 9/1998 Zoltaszek ..... B21J 15/26 222/390
6,141,849 A * 11/2000 Honsel ..... B21J 15/26 29/243.521
6,237,390 B1 * 5/2001 Honsel ..... B21J 15/043 29/243.526
6,301,948 B1 * 10/2001 Weiland ..... B21J 15/043 29/243.525
6,904,831 B2 * 6/2005 Aasgaard ..... B21J 15/048 29/243.53
2009/0205192 A1 * 8/2009 King ..... B21J 15/043 29/525.06
2010/0036628 A1 * 2/2010 Plestid ..... G01R 31/3679 702/63
2010/0071182 A1 * 3/2010 Ho ..... B21J 15/043 29/243.53
2011/0239449 A1 * 10/2011 Masugata ..... B21J 15/043 29/715
2011/0250482 A1 * 10/2011 Henderson, Jr. .... H01M 2/1055 429/97
2013/0212849 A1 * 8/2013 Soller ..... B21J 15/043 29/243.521

FOREIGN PATENT DOCUMENTS

| | | |
|---|---|---|
| CN | 101745597 | 6/2010 |
| CN | 101992253 | 3/2011 |
| CN | 202029842 U | 11/2011 |
| CN | 103180066 | 6/2013 |
| DE | 41 26 602 | 2/1993 |
| TW | 201012600 | 4/2010 |

OTHER PUBLICATIONS

European Search Report conducted in counterpart European Appln. No. 14 156 307.2-1702 (dated Oct. 15, 2014) (w/ machine translation).
Chinese Office Action issued in Application No. 201510087386.9, dated Jan. 3, 2017, along with an English translation thereof.

* cited by examiner

BLIND RIVET SETTING DEVICE

CROSS-REFERENCE TO RELATED APPLICATIONS

The present application claims priority under 35 U.S.C. §119 of European Patent Application No. 14 156 307.2, filed Feb. 24, 2014, the disclosure of which is expressly incorporated by reference herein in its entirety.

BACKGROUND OF THE INVENTION

1. Field of the Invention

Embodiments of the invention relate to a blind rivet setting device having a housing, a pulling mechanism in the housing, which comprises a chuck housing that can be moved in a pulling direction and clamping jaws that can be moved along a clamping distance in the chuck housing, an electric drive, which acts on the chuck housing and comprises a control device, and an electric battery as an energy source for the drive.

2. Discussion of Background Information

A blind rivet setting device of this type is, for example, known from DE 41 26 602 A1.

"Blind rivet setting device" is to be understood below as meaning a device that can be used to set blind rivets, blind rivet nuts, and blind rivet fasteners generally. To set a blind rivet fastener of this type, the blind rivet fastener is inserted into an opening in a structure, for example, a wall or a plate, until the set head of the fastener bears against the structure. With the aid of the blind rivet setting device, a pulling force is subsequently applied to a pulling mandrel that is arranged in the blind rivet fastener, which force causes the part of the blind rivet fastener located on the other side of the structure to be shaped and form a closing head. A procedure of this type is known per se.

The use of a battery, which can also be embodied as a rechargeable battery, as an energy source has the advantage that the handling of the blind rivet setting device is not encumbered by an electric supply line. However, an embodiment of this type has the disadvantage that the battery only holds a limited supply of energy and that the number of blind rivet fasteners that are to be set is therefore limited.

SUMMARY OF THE EMBODIMENTS

Embodiments of the invention are directed to a blind rivet setting device with which a largest possible number of blind rivet fasteners can be set.

Accordingly, a blind rivet setting device of the type named at the outset includes chuck housing that includes, for each clamping jaw, a guide path with a path base slanted against the pulling direction. Further, each clamping jaw bears against a respective path base so that its back lies flat against the path base over the clamping distance. A spring is provided which applies a force to the clamping jaws into the chuck housing.

Thus, not only are the clamping jaws guided in an inner cone, against which they bear virtually with only one line, but the clamping jaws are also guided in a type of channel, so that the force which the chuck housing applies radially inwards to the clamping jaws can be introduced into the clamping jaws over a larger area. Furthermore, the guide paths prevent a lateral deviation of the clamping jaws in a circumferential direction. In this manner, it can be achieved that a larger portion of the power produced by the electric drive can be converted into the pulling force and that only a smaller portion is required to produce the clamping force. The pulling force necessary for setting a blind rivet fastener and the pulling distance required to form the closing head depend on the blind rivet fastener. In the case of otherwise identical blind rivet fasteners, a larger number of blind rivet fasteners can be set with the described embodiment of the pulling mechanism, since less electric energy is necessary for the production of the clamping force. Aside from this, the wear is less and the amount of time required for maintenance is thus lower, so that the availability of the device increases.

Preferably, the drive comprises a single position sensor for the pulling mechanism, wherein the electric drive comprises a revolution counter. The revolution counter measures the number of revolutions that the electric drive has completed. The electric drive acts on the pulling mechanism via a transmission, of which the gear ratio is known. Thus, if the information about the completed revolutions of the electric drive is available, then information about the distance traveled by the pulling mechanism is also available. This information normally allows the current position of the pulling mechanism to be determined with relatively high precision. Accordingly, the pulling device can thus be moved relatively accurately into predetermined positions so that superfluous movements can be avoided. This also saves electric driving energy. The revolution counter can also be embodied in the control device, for example, if the electric drive comprises a brushless direct current motor (BLDC motor) that is actuated by voltage pulses generated by the control device.

Preferably, the electric drive can be actuated at a higher frequency than the working frequency. If the control device actuates the electric drive with a higher frequency, then there results an acoustically perceptible signal, which can also be referred to as a "beeping" or "buzzing." In this case, it is not absolutely necessary that the drive rotate further or move in another manner. The higher-frequency actuation can be used to convey information to a user of the blind rivet setting device. For example, the user can be alerted when the battery falls below a particular charge state.

Preferably, the control device comprises a charge state monitoring device for the battery. The user thus has the ability to obtain information about the charge state of the battery on a continuous basis. The user can then assess whether to use the currently available battery for a planned task, for example, setting a predetermined number of blind rivet fasteners, or whether it is desirable to exchange it for a new battery with a greater charge quantity.

Here, it is preferred that the charge state monitoring device has a signaling or shutoff following a last complete setting operation. If the charge state of the battery would no longer suffice for an additional setting operation of a blind rivet fastener, this can be signaled to the user at the end of the "last" complete setting operation, for example. The signaling can occur optically, acoustically and/or in another manner, for example, in that the voltage supply is switched off. The risk of a blind rivet fastener no longer being properly set, which would necessitate a costly reworking, is thus eliminated.

Preferably, the battery comprises a data storage medium which contains charging information. The charge state monitoring device can then make use of this information in order to correctly assess the charge state.

Preferably, the electric drive has an energy return feed. At the end of the setting operation, moved parts must be decelerated. The braking energy is then no longer completely converted into heat, but rather can be recovered as electric energy and fed back into the battery. A heating of the device can be reduced.

Preferably, the drive acts on the chuck housing via a ball screw which has a pitch on the order of magnitude of 4 mm. A relatively large gear reduction is thus achieved, that is, the electric drive must produce a smaller torque to produce the pulling force than when a ball screw with a pitch of 5 mm is used. In many cases, the drawn current and the torque are not linearly related, but rather the current increases disproportionately with increasing torque. Through the use of a correspondingly smaller thread pitch, the increase of the current draw can then be limited.

Here, it is preferred that the ball screw comprises balls that are typically used for a 5 mm pitch. The balls are thus essentially "too large" for the ball screw. In this manner, larger mechanical loads can be accommodated.

Preferably, the housing comprises on its front face a lighting device that can be operated in at least two different modes. In addition to the "off" mode, a "constant light" mode and a "process light" mode can be used, for example. In the "constant light" mode, a type of flashlight effect is produced. In the "process light" mode, a beam of light is directed at the blind rivet fastener that is being set during the setting operation.

Preferably, the battery is a rechargeable battery and comprises a first encoding for the blind rivet setting device and a second encoding for a charging device. The encoding can be embodied in a mechanical, electrical, optical or other manner. By the double encoding, it is ensured that, not only will the battery be used with the correct blind rivet setting device, but the battery will only be charged by the correct charging device. The risk of the durability of the battery being impaired by improper handling and the attainable charge state being reduced is thus small.

Preferably, the battery is connected to the housing by a sliding connection. In the case of known blind rivet setting devices, the battery is inserted into the handle piece of the housing from below. During operation, the battery is then located at the bottom in the direction of gravity, and there exists the danger of the battery falling out of the housing and injuring the technician or of the battery simply being lost, for example, at construction sites. With a sliding connection, the battery can still be arranged at the bottom end of the housing, which results in an advantageous weight distribution for the technician during handling. However, in this position, it is placed onto the housing perpendicular to the direction of gravity and is then connected to the housing by means of the sliding connection.

It is also advantageous if the battery is secured in the housing by at least two mechanical locks that are arranged one after another in the sliding direction. This reduces the risk of the battery falling out of the housing and being able to cause injuries or damage.

Preferably, the pulling mechanism has a pulling distance of at least 25 mm. There thus results a relatively large field of application for the blind rivet setting device. It can also be used for multigrip rivets.

Embodiments of the invention are directed to a blind rivet setting device that includes a housing; a pulling mechanism, arranged in the housing, that includes a chuck housing movable in a pulling direction and clamping jaws movable along a clamping distance in the chuck housing; an electric drive, structured and arranged to act on the chuck housing, that includes a control device, a single position sensor for the pulling mechanism and a revolution counter; an electric battery structured and arranged as an energy source for the electric drive; and a spring structured and arranged in the chuck housing to apply a force to clamping jaws. For each clamping jaw, the chuck housing includes a guide path with a path base obliquely oriented to the pulling direction, and a back of each clamping jaw is supported against its respective path base over the clamping distance.

According to embodiments, the electric drive may be actuatable with a higher frequency than the working frequency.

In other embodiments, the control device may include a charge state monitor for the battery. The charge state monitor can be structured for at least one of a signaling and a shutoff following a last complete setting operation. Further, the battery can include a data storage medium containing charging information.

According to still other embodiments, the electric drive can include an energy return feed.

In accordance with other embodiments, the electric drive may be structured to act on the chuck housing via a ball screw having a pitch of about 4 mm. Further, the ball screw can include balls structured for a 5 mm pitch.

In embodiments, the housing may include a front face and a lighting device located on the front face. The lighting device can be operable in at least two different modes.

According to embodiments, the battery may be a rechargeable battery including a first encoding readable by the blind rivet setting device and a second encoding readable by a charging device.

Moreover, the battery can be connectable to the housing via a sliding connection.

In still other embodiments, the battery can be secured in the housing by at least two mechanical locks arranged one after another in a sliding direction of the sliding connection.

In embodiments, the pulling mechanism can have a pulling distance of at least 25 mm.

According to still further embodiments, the pulling mechanism may include a spindle coupled to the chuck housing and a rotatable nut to drive the spindle. Further, a transmission can be arranged between the electric drive and the rotatable nut.

In accordance with still other embodiments, the clamping jaws can include one of a fluting or surface treatment to improve a gripping of a mandrel by the clamping jaws.

Embodiments of the invention are directed to a method of setting a blind rivet that includes grasping a mandrel of the blind rivet with clamping jaws biased to be linearly movable along a path obliquely oriented to a pulling direction of the mandrel; and pulling the mandrel until a set head is formed.

In accordance with still yet other embodiments of the present invention, the pulling of the mandrel is achieved by pulling a chuck housing in which the clamping jaws are arranged via an electric drive. The method may also include determining a position of the chuck housing while pulling the mandrel by at least one of a single position sensor and a revolution counter.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

Figure 1:
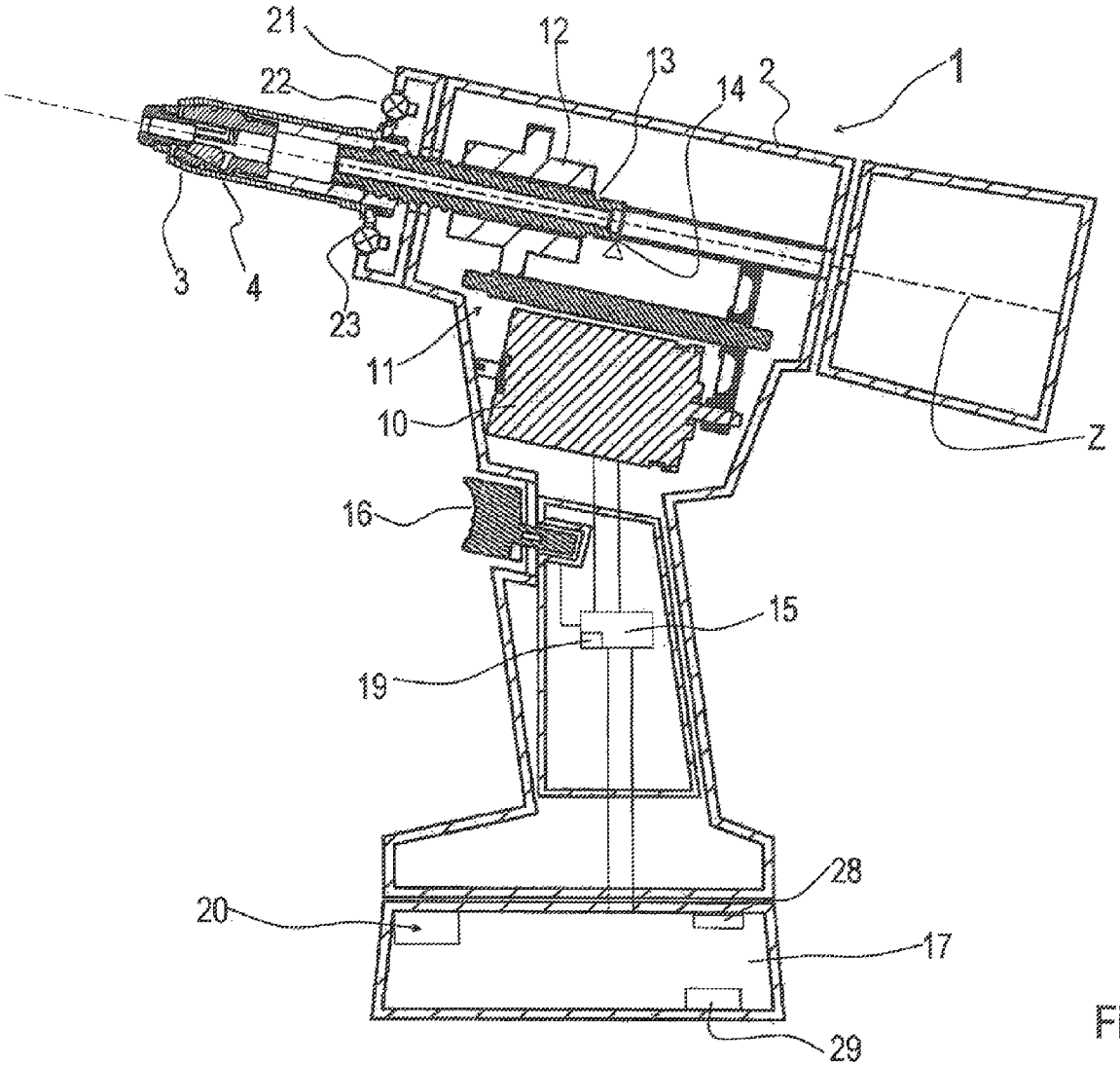
FIG. 1 shows a schematic sectional view of a blind rivet setting device.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A blind rivet setting device 1 that can be used to set blind rivet fasteners, such as blind rivets, blind rivet nuts or the like, comprises a housing 2 in which a pulling mechanism is arranged. The pulling mechanism comprises a chuck housing 3 that can be moved in a pulling direction (dash-dotted line Z). Multiple clamping jaws 4 are arranged in chuck housing 3. Each clamping jaw 4 is arranged in guide path 5 which, as this can be seen in FIG. 2, comprises a path base 6 oriented obliquely to or slanted against the pulling direction Z. A back of clamping jaw 4 bears against path base 6. In this way, guide path 5 forms a support for clamping jaw 4, so that clamping jaw 4 is supported for linear movement as the back of clamping jaw 4 lies flat against path base 6 in every position of movement.

Figure 2:
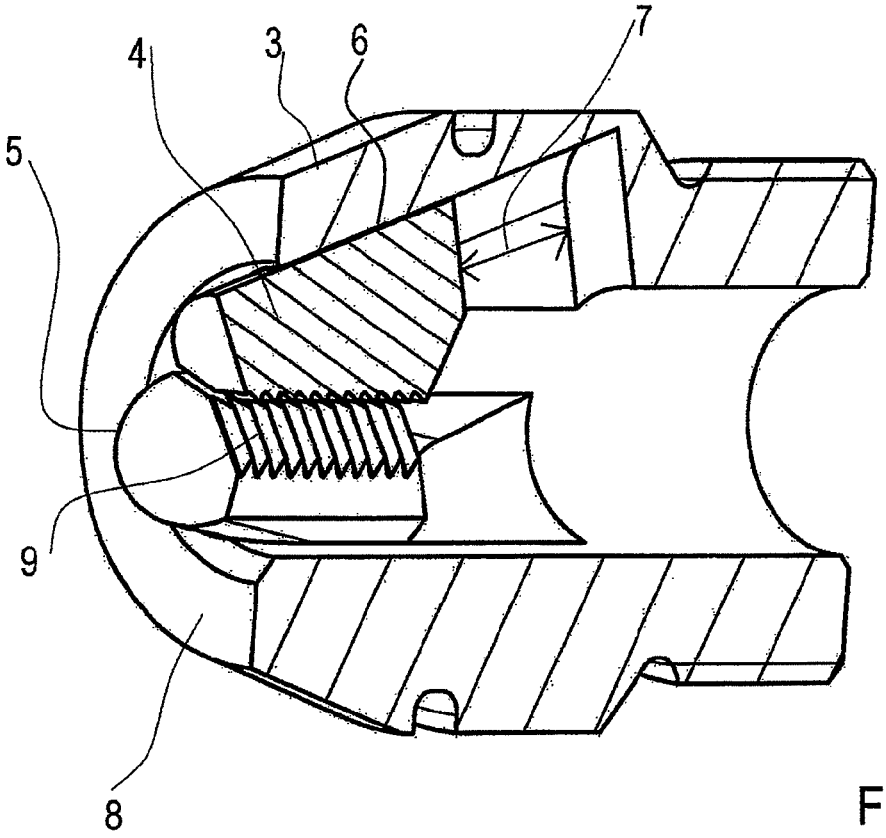
FIG. 2 shows a perspective representation of a clamping jaw arrangement.
Figure 3:
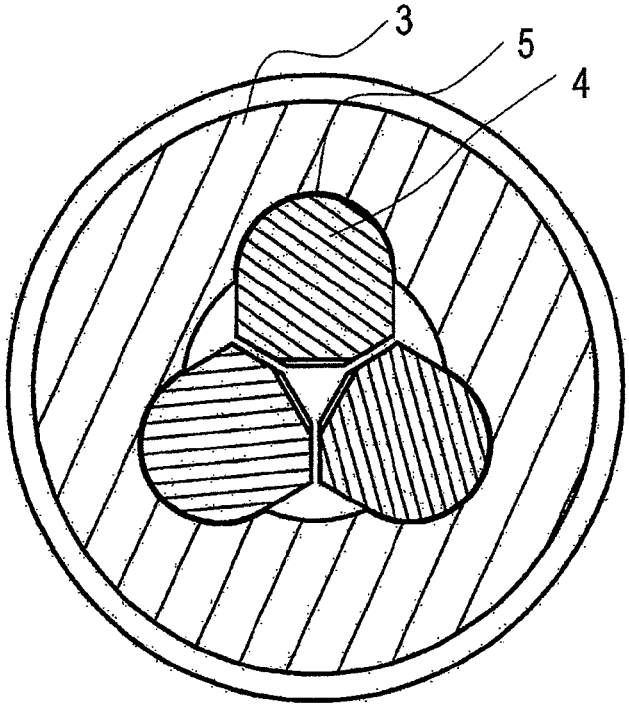
FIG. 3 shows a sectional view through a clamping jaw arrangement.

By force of a spring element, which symbolized in the FIG. 2 by a double arrow 7, a force is applied to each clamping jaw 4 to bias or urge clamping jaw 4 towards a front end 8 of chuck housing 3. This force ensures that clamping jaws 4 move into a closing position illustrated in FIG. 2 when no external forces act on clamping jaws 4. Clamping jaws 4 have on their inside 9 a fluting or another surface geometry that is structured and arranged to improve engagement with a rivet mandrel (not illustrated).

As mentioned above, clamping jaws 4 are guided in a channel, i.e., guide path 5, so that the backs of clamping jaws 4 are supported against path base 6 in a planar manner. Guide paths 5 also prevent a lateral deviation of clamping jaws 4 in a circumferential direction. When a blind rivet fastener is set, a portion of the pulling force produced is used to form a closing head of the blind rivet fastener. Another portion of the pulling force is used to generate a clamping force with which clamping jaws 4 bear against the rivet mandrel. With the described embodiment, this portion of the pulling force that is used to produce the clamping force can be reduced.

To move chuck housing 3, an electric drive 10 is provided to act on chuck housing 3 via a transmission 11 and to displace chuck housing 3 in pulling direction Z. Transmission 11 comprises a spindle nut 12, which is positioned in the housing in a fixed, yet rotatable manner, and a threaded spindle 13. Spindle nut 12 and threaded spindle 13 preferably have a pitch on the order of magnitude of 4 mm, i.e., threaded spindle 13 travels a distance of approximately 4 mm in pulling direction Z per revolution of spindle nut 12. Between spindle nut 12 and threaded spindle 13, balls or ball bearings, which are normally used for a 5 mm pitch, are arranged. Thus, while balls are actually too large for the ball screw formed from spindle nut 12 and threaded spindle 13, larger mechanical loads can be accommodated by these larger balls.

A position sensor 14, which detects the position of threaded spindle 13, and therefore, the position of chuck housing 3, is schematically illustrated. However, it is understood that position sensor 14 can also be arranged in a different position. In the illustrated embodiment, there is only this single position sensor 14. Electric drive 10 comprises a revolution counter. Because a gear ratio of transmission 11 is known, it is possible, by counting the revolutions of electric drive 10, to precisely determine the position in which threaded spindle 13 and therefore chuck housing 3 are located, so that a very accurate motion control of the pulling mechanism with threaded spindle 13 and chuck housing 3 is possible.

A control device 15 that is connected to a switch 16 is schematically illustrated. When switch 16 is operated, control device 15 actuates electric drive 10. Moreover, by way of non-limiting example, if electric drive 10 is embodied as a brushless direct current motor that reacts to pulses from control device 15, control device 15 can form the revolution counter, e.g.

Furthermore, the control device 15 is connected to a battery 17 that holds a supply of energy for the electric drive 10.

The control device can comprise a charge state monitoring device 19, so that the user can obtain information about the charge state of battery 17 on a continuous basis. Charge state monitoring device 19 can be connected to a display that is not shown in greater detail. However, it is also possible to connect charge state monitoring device 19 to a color indicator so that the user is informed of the charge state, for example, the state in which the charge is sufficient can be indicated by the color "green," the state in which the battery is gradually approaching an uncharged state can be indicated by the color "yellow," and the state in which further work is no longer possible using battery 17 and/or the battery 17 should be replaced can be indicated by the color "red."

Charge state monitoring device 19 can also signal that the last setting operation possible with the charge of battery 17 has occurred. In this regard, this signaling can take place by an acoustic, optical or other signal, e.g., vibrations. However, it is also possible that charge state monitoring device 19 can be structured to simply deactivate blind rivet setting device 1 if the charge of the battery 17 is sufficient to begin a blind rivet fastener setting operation, but not sufficient to complete this setting operation. In the case of a deactivated blind rivet setting device 1, blind rivet setting device 1 shows no reaction when the user operates switch 16.

Control device 15 can also be used in order to actuate electric drive 10 with a frequency that is higher than the working frequency. In this case, spindle nut 12 is not noticeably rotated, but rather electric drive 10 creates an audible sound. A signaling of this type can be used to indicate different operating states to the user.

In the present case, battery 17 comprises a data storage medium 20 which contains charge information. Data storage medium 20 can, e.g., be updated after a charging operation of battery 17 and after each setting operation, so that current information for the charge state is always available.

Control device 15 can also be embodied in such a manner that it can achieve an energy return feed from electric drive 10 into battery 17, e.g., when electric drive 10 is decelerated at an end of a setting operation.

Preferably, housing 2 comprises on its front face 21 a lighting device 22, 23 that can be operated, e.g., in at least two different modes. One mode can be a "constant light" operation, e.g., in which lighting device 22, 23 continuously emits light. In this way, blind rivet setting device 1 can then be used as a flashlight, as it were. Another mode can be that the light is directed at the blind rivet fastener being set during a setting operation.

Battery 17 is arranged at an end of housing 2 which faces away from the pulling mechanism comprising threaded spindle 13 and clamping jaws 4. For the sake of simplicity, this end is referred to as the "bottom end." Battery 17 can be connected to housing 2 by a sliding connection. With reference to the illustration in FIG. 1, battery 17 can be placed onto the bottom end of housing 2 from the side and may then be slid from left to right or from right to left with reference to the drawing plane, or perpendicular to the drawing plane, in order to engage with housing 2. If blind rivet setting device 1 is held with the bottom end facing downwards in the direction of gravity, it is thus not possible for battery 17 to simply fall out of housing 2.

Figure 4:
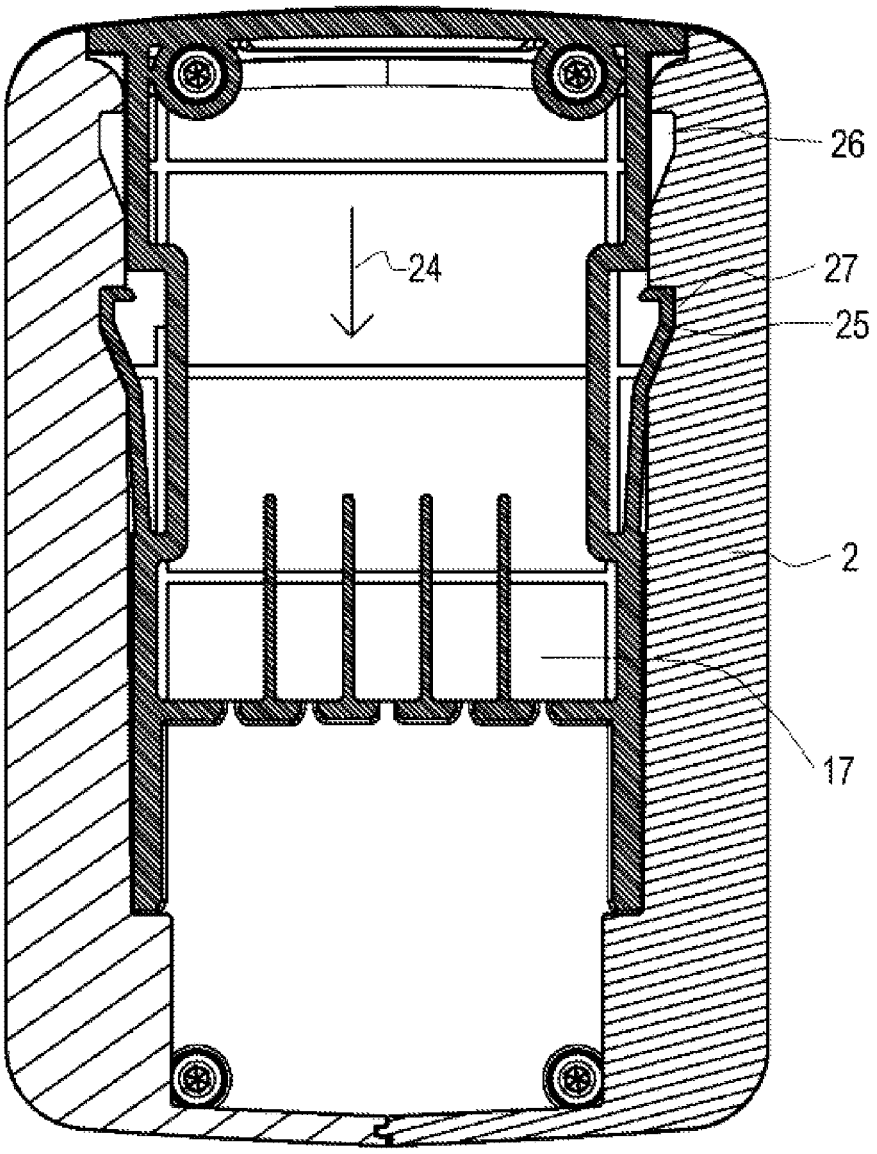
FIG. 4 shows a schematic representation of a battery attachment.

As illustrated in FIG. 4, the battery is secured in housing 2 by at least two mechanical locks. The mechanical locks can arranged one after another in a sliding direction symbolized by an arrow 24. Battery can include hooks 25 that can be springingly biased outwards, and battery 17 can include a first recess 26 and a second recess 27 separated in sliding direction 24 so that, each hook 25 can engage either first recess 26 and second recess 27. Even if a locking connection between hook 25 and second recess 27 is inadvertently or accidentally released, battery 17 still cannot be removed from housing 2 without difficulty, since hook 25 would engage in first recess 26.

Battery 17 can further comprise a first encoding 28 and a second encoding 29, as illustrated in FIG. 1. First encoding 28 can be verified by blind rivet setting device 1 so that it is ensured that blind rivet setting device 1 can only be operated with a suitable battery 17. Further, second encoding 29 can be provided for coupling with a charging device (not illustrated), so that it can be ensured that a correct charging device is connected to battery 17 for charging. Encodings 28, 29 can be embodied in a mechanical, electrical, optical or other manner.

The pulling mechanism with the clamping jaws 4 has a pulling distance of at least 25 mm. Thus, there results a relatively large field of application for blind rivet setting device 1. Moreover, blind rivet setting device 1 can also be used for multigrip rivets.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A blind rivet setting device comprising:

a housing;

a pulling mechanism, arranged in the housing, the pulling mechanism including a chuck housing movable in a pulling direction and a plurality of clamping jaws movable along a clamping distance in the chuck housing;

an electric drive, structured and arranged to act on the chuck housing, the electric drive including a control device, a single position sensor for the pulling mechanism and a revolution counter;

an electric battery structured and arranged as an energy source for the electric drive;

for each clamping jaw, the chuck housing including a guide path with a path base obliquely oriented to the pulling direction, and a back of each clamping jaw is supported against the respective path base of each clamping jaw in a planar manner over the clamping distance; and for each clamping jaw, a spring being structured and arranged in the chuck housing to apply a biasing force along the respective obliquely oriented path base of each guide path.

2. The blind rivet setting device according to claim 1, wherein the electric drive is actuatable with a higher frequency than a working frequency.

3. The blind rivet setting device according to claim 1, wherein the control device comprises a charge state monitor for the battery.

4. The blind rivet setting device according to claim 3, wherein the charge state monitor is structured for at least one of a signaling and a shutoff following a last complete setting operation.

5. The blind rivet setting device according to claim 4, wherein the battery comprises a data storage medium containing charging information.

6. The blind rivet setting device according to claim 1, wherein the electric drive comprises an energy return feed.

7. The blind rivet setting device according to claim 1, wherein the electric drive is structured to act on the chuck housing via a ball screw having a pitch of about 4 mm and less than 5 mm.

8. The blind rivet setting device according to claim 7, wherein the ball screw comprises balls structured for a 5 mm pitch.

9. The blind rivet setting device according to claim 1, wherein the housing comprises a front face and a lighting device located on the front face.

10. The blind rivet setting device according to claim 9, wherein the lighting device is operable in at least two different modes.

11. The blind rivet setting device according to claim 1, wherein the battery is a rechargeable battery comprising a first encoding readable by the blind rivet setting device and a second encoding readable by a charging device.

12. The blind rivet setting device according to claim 1, wherein the battery is connectable to the housing via a sliding connection.

13. The blind rivet setting device according to claim 1, wherein the battery is secured in the housing by at least two mechanical locks arranged one after another in a sliding direction of a sliding connection.

14. The blind rivet setting device according to claim 1, wherein the pulling mechanism has a pulling distance of at least 25 mm.

15. The blind rivet setting device according to claim 1, wherein the pulling mechanism comprises a spindle coupled to the chuck housing and a rotatable nut to drive the spindle.

16. The blind rivet setting device according to claim 15, further comprising a transmission arranged between the electric drive and the rotatable nut.

17. The blind rivet setting device according to claim 1, wherein the clamping jaws comprise one of a fluting or surface treatment to improve a gripping of a mandrel by the clamping jaws.

18. The blind rivet setting device according to claim 1, wherein the ball screw comprises balls structured for a 5 mm pitch and the electric drive is structured to act on the chuck housing via a ball screw having a pitch of less than 5 mm.

19. A method of setting a blind rivet, using the blind rivet setting device of claim 1, said method comprising:

grasping a mandrel of the blind rivet with clamping jaws biased to be linearly movable along a path obliquely oriented to a pulling direction of the mandrel; and pulling the mandrel until a set head is formed.

20. The method according to claim 19, wherein the pulling of the mandrel is achieved by pulling the chuck housing in which the clamping jaws are arranged via the electric drive.

21. The method of claim 20, further comprising determining a position of the chuck housing while pulling the mandrel by at least one of a single position sensor and a revolution counter.

* * * * *